US006315495B1

(12) United States Patent
Starheim

(10) Patent No.: US 6,315,495 B1
(45) Date of Patent: Nov. 13, 2001

(54) PORTABLE ENVIRONMENTAL CONTAINMENT SYSTEM

(76) Inventor: Scot A Starheim, 4304 SW. Frontenac, Seattle, WA (US) 98136

( * ) Notice: Subject to any disclaimer, the term of this patent is extended or adjusted under 35 U.S.C. 154(b) by 0 days.

(21) Appl. No.: 09/557,932

(22) Filed: Apr. 22, 2000

Related U.S. Application Data

(60) Provisional application No. 60/144,908, filed on Jul. 21, 1999.

(51) Int. Cl.[7] ..... E02B 7/00

(52) U.S. Cl. ..... 405/129.8; 405/129.75; 405/129.6; 405/129.55; 405/284; 220/4.33; 220/495.11

(58) Field of Search ..... 405/258, 262, 405/284, 285, 286, 128, 129; 220/495.08, 495.11, 4.33; 52/79.5

(56) References Cited

U.S. PATENT DOCUMENTS

| | | | | |
|---|---|---|---|---|
| 3,757,990 | * | 9/1973 | Buth | 220/570 |
| 4,796,392 | * | 1/1989 | Graham, Jr. | 52/79.5 |
| 5,077,945 | * | 1/1992 | Koeniger | 405/114 |
| 5,096,086 | * | 3/1992 | Crema | 220/533 |
| 5,098,220 | | 3/1992 | Norman . | |
| 5,236,281 | | 8/1993 | Middleton . | |
| 5,377,857 | * | 1/1995 | Taravella et al. | 220/4.33 |
| 5,520,477 | | 5/1996 | Fink . | |
| 5,622,864 | * | 4/1997 | Buchanan | 405/128 |
| 5,638,973 | * | 6/1997 | Dewey et al. | 220/4.33 |
| 5,722,551 | * | 3/1998 | Cocciemiglio, Jr. | 220/4.33 |
| 5,800,091 | | 9/1998 | Romer . | |
| 5,820,297 | | 10/1998 | Middleton . | |
| 5,857,304 | | 1/1999 | Karten . | |
| 5,882,142 | | 3/1999 | Siglin . | |

* cited by examiner

*Primary Examiner*—David Bagnell
*Assistant Examiner*—Frederick L. Lagman

(57) ABSTRACT

A temporary berm or bin system, easily transported, erected without tools, and easily dismantled. A set of panels or planks is joined with sliding clips to form a bin having vertical or near vertical sides. The bin is lined with an impervious sheet of geocloth to form a containment berm for use in controlling the dispersal of hazardous material spilled from storage or work facilities. Spring loaded clamps hold the geocloth securely to the uppermost plank without nailing, sewing, or other labor consuming and/or tear prone methods. The berm is particularly suited to protect oil well drilling sites in environmentally sensitive environments such as arctic tundra. No excavation or other disturbance of the soil is required to erect the protective berm. The berm is secured to the ground by spildng through triangular support gussets. In the arctic, securing may be accomplished by freezing ice or mud as an "ice mortar" over the gusset feet and along the lower edge of the planking. The berm system may be transported by ordinary truck, specially adapted transport/laying truck, or on a portable drilling platform.

21 Claims, 6 Drawing Sheets

PORTABLE ENVIRONMENTAL CONTAINMENT SYSTEM

RELATED APPLICATIONS

The present application claims benefit of the filing date of co-pending Provisional Application No. 60/144,908, titled "Portable Environmental Containment System", filed in Jul., 21, 1999, and incorporates said provisional application by reference.

BACKGROUND OF THE INVENTION

1. Field of Invention

This invention pertains to temporary structures serving as retaining berms or bins for holding hazardous material against escaping. In particular, to prevent oil well drilling mud and other fluids released during drilling operations from escaping the site, and to protect the environment near the tank batteries used for holding drilling fluids, fuel, and supplies. The system may be stored and transported as part of a drilling rig.

2. Description of Prior Art

In environments where the soil may be disturbed, earth is piled up in berms to form a closed area then covered with an impervious sheet of geocloth or similar. Earth berms require heavy equipment to scoop and pile dirt and to push it back into place when the need for the holding pen is over. In environments where the soil cannot be disturbed, is too hard, or is delicate tundra, timbers such as old railroad ties are stacked as a pen and the impervious geocloth secured to the timbers by nailing. The timber berms require heavy equipment to place and remove. Timbers generally are too heavy to handle without machinery and if treated with creosote or other preservatives, they may leach toxic chemicals into the ground where they are placed. This small but significant contamination has to be scooped up and removed for proper disposal. The heavy timbers require larger hauling equipment and more storage space than the invention described herein.

The patent literature shows several portable or temporary holding, berm-like, structures. Most are for special purposes, not suitable for general or arctic use.

U.S. Pat. No. 5,098,220, by Carol Norman, shows a shallow pit lined with an impervious sheeting surrounding an oil well head. The marginal attachment is not shown and the text indicates that there are several methods in use. The railroad ties described above are likely to be one suitable means. Miss Norman's invention is intended for finished wells, and is insufficient for use as protection during the drilling operation.

U.S. Pat. No. 5,236,281, by Dennis Middleton, describes a polyurethane dike device (berm) for use on concrete floors. Sections of the berm or dyke are joined by gluing a form-fitting molded splice piece across the interstitial space between adjacent linear sections. The assembly cannot be disassembled without destroying at least part of the components, rendering them not reusable.

U.S. Pat. No. 5,802,297, also by Dennis Middleton, is a similar device. It is foam filled and designed to be glued to a flat floor. Joining is by gluing a splice piece cut from sheet stock over the joint.

U.S. Pat. No. 5,800,091, by Edward Van Romer, is another dyke similar to the Middleton invention, except that the supporting structure is pneumatic and the dyke is sufficiently pliable to permit a wheeled vehicle to roll over the wall portion.

U.S. Pat. No. 5,520,477, by Kevin Fink, uses honeycomb core panels connected by H shaped joiners in cooperation with clips having securing barbs. At first glance the clips resemble the membrane-holding clips of the present invention. However, examination discloses that the barbs are not for holding any third component (membrane) in place. They are intermediaries between the panel edges and the H joining bar. The barbs fit into cooperating grooves or holes in the panel and H bar. The Fink figures clearly show this. In particular, FIGS. 4–12.

The Fink panel joining and corner assemblies have no resemblance to the structures of the present invention.

U.S. Pat. No. 5,857,304, by Stuart Karten, et al, has a key-way cut into the ends of the panels and a key system sliding into the key-ways, thereby joining two panels together. The present invention has no key-ways.

U.S. Pat. No. 5,882,142, by Donald Siglin, et al, is a permanent containment dike comprising panels bolted to posts set into concrete and lined with an impervious sheet of geotexfile, which is secured to the upper rim of the wall by bolted clamps. This system requires considerable labor, precision placement of the posts, and does environmental damage. In contrast to the present invention, Siglin bolts the panels at overlapping joints The Siglin invention uses nuts and bolts as joining fasteners. Nuts and bolts rust tight, making the Siglin dike un-repairable in the best of working conditions. Stainless steel or brass nuts and bolts may reduce the seizing problems at great expense. However, under arctic conditions, the normally simple chore of starting a nut on a bolt, then tightening with a pair of wrenches is a very difficult task. Loosening and removing nuts and bolts which may be frozen in place with ice is also more difficult than expected. Nuts and bolts and wrenches are awkward to handle with arctic gloves and are likely to be dropped, leaving a litter.

The present invention has no nuts and bolts.

The Siglin dike uses posts set in concrete to support the wall sections. Concrete does not set well in freezing conditions. Thus, the Siglin dike cannot be installed in winter in many parts of the world, especially in permafrost zones.

The present invention does not rely on concrete. Furthermore, the present invention can utilize arctic cold to make an "ice mortar" or "ice-crete" of ice, frozen mud, or the like, for holding the structure in place.

3. Objects of the Invention

It is an object of the present invention to construct a temporary containment berm using reusable panel modules and other component parts requiring no machinery or power tools to assemble or disassemble.

It is another object of the present invention to be reusable and leave no environmental impact behind when removed.

It is another object of the present invention to be able to construct a temporary containment berm using panel modules and other component parts fabricated from metal or composite sheet stock.

It is another object of the present invention to be able to repair the berm on-site with hand tools or common hand-held power tools.

It is another object of the present invention that the invention be usable under arctic conditions including while wearing cumbersome arctic gloves and other gear.

It is another object of the present invention to be transportable by truck and manually installed.

It is another object of the invention to be transportable on an erection truck, trailer, or skid module using the transporter to place the liner and other components.

It is another object of the invention to be removably attached to a drilling rig, thereby being transported as part of a drilling rig or platform.

It is another object of the invention that the berm confines the spread of liquids or slurries.

SUMMARY OF THE INVENTION

Panels or planks are cut from sheet stock generally ¼ to ½ inch aluminum flat stock. Z or jogged plates are attached near the panel ends forming hooks to cooperage with clips for joining panels. In the central portion of the panels the hooks are arranged in pairs forming a track or key-way slots to accept triangular load supporting gusset brackets having pads for supporting weight and having wings which slide into the key-ways.

The end hooks accept clips which are either flat for joining plates in-line or corners bent to form dihedral angles to form bin corners. Clips designed for in-line joining are essentially flat and cooperage with the jogged plates to clip into the end hooks to hold the panels end to end forming long berm or bin walls. The clips for joining panels end to end also carry key-way slots similar to the key-way slots on the panels. Support brackets attach to the joining clips in the same manner as used to attach directly to the panels.

The corner clips are bent an appropriate amount to tun the bin wall. This is usually 90 degrees, but may be any amount. Preferred turning is 125 and 157.5 degrees internal angle. Others may be bent as required, or a hinged corner piece may be used. No support gussets are required at the corners.

Panels may be in several lengths, widths (height), and thicknesses, the preferred panel lengths being 4, 6, and 8 feet in length. The preferred panel width is 12 to 24 inches. The preferred panel thickness is ¼ to ½ inch.

Rows of panels are stackable using gusset brackets which are large enough to span more than one row. The gussets then act as tie studs between the stacked panels. The larger gussets capable of spanning two or more stacked rows are automatically scaled to support the larger loads expected when the berm or bin becomes filled.

Sections can be removed easily to permit passage of vehicles bringing in supplies or removing equipment then easily replaced by workmen of the skill levels and tools commonly found around drilling operations. Similarly, accidentally damaged sections can be quickly and inexpensively replaced, thus avoiding fines and other complications from possible violation of environmental protection laws.

INDEX OF DETAILED ELEMENTS

Figure 1:
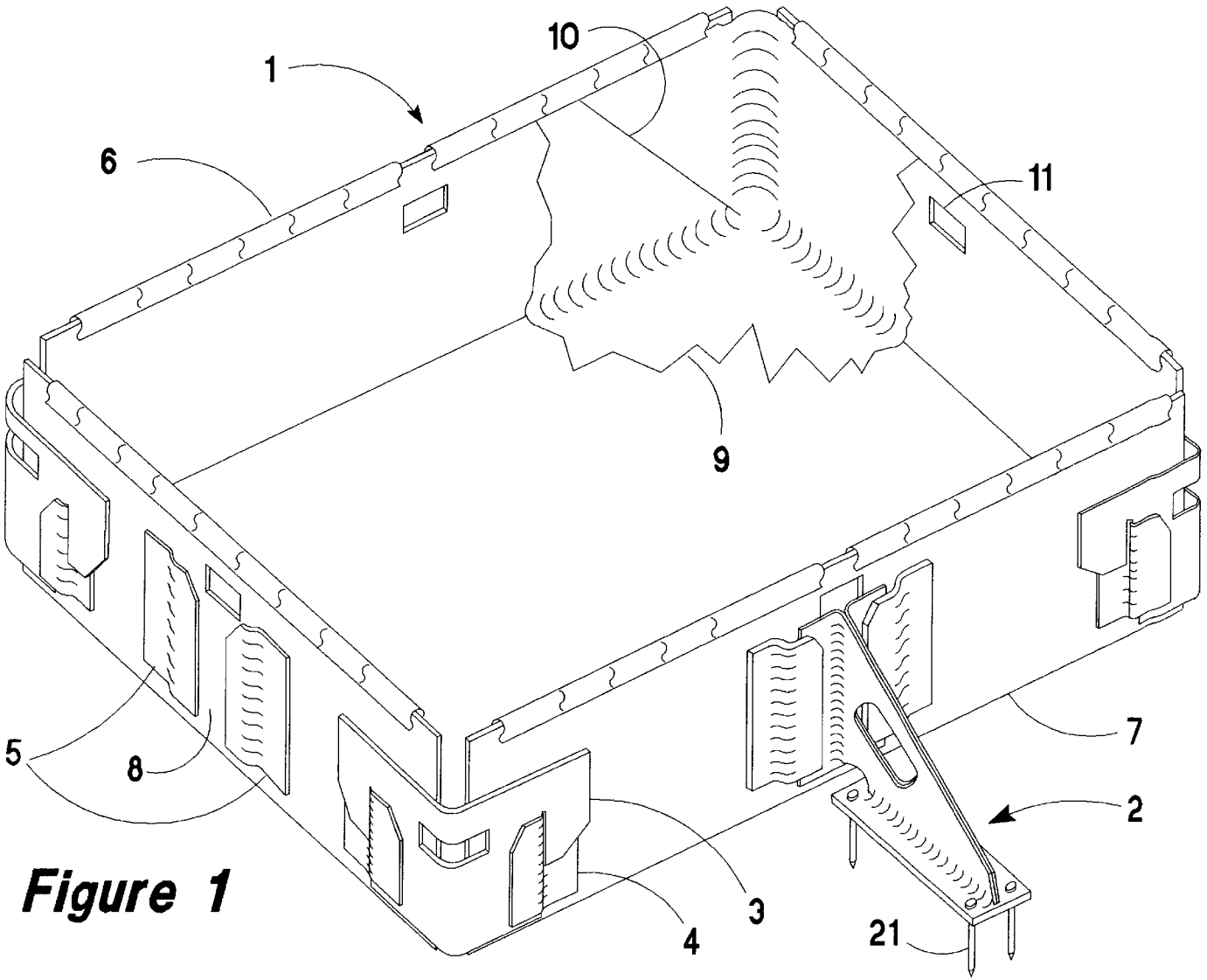
FIG. 1 is an isometric view of an embodiment of the assembled invention.

1. Berm assembly, general
2. Support bracket assembly, general
3. Corner joining clip
4. Joining hook, part of panel
5. Support bracket attachment hook
6. Liner retaining clamp
7. Berm wall panel
8. Support bracket attachment slot
10. Liner fold
11. Panel hand hold
12. Joining clip, general
13. Hand hold in clip
14. Joining clip blank
15. Receiving slot for panel hook.
16. Gusset retaining hook (pair)
17. Gusset receiving slot
18. Bracket foot
19. Spike receiving holes in bracket foot
20. Gusset
21. Hand hold or lightening cutout
22. Gusset wings
23. Panel with integral supporting bracket or gussets, general.
24. Fixed support gusset or bracket
25. Hand hold.
26. Mounting holes for attaching to a drill rig.
27. Hold down spike
28. Hold down pad
29. Low berm embodiment, general
30. Low berm wall
31. Low berm footing
32. Low berm joining slot
33. Low berm foot wings
34. Low berm joining piece, general
35. Low berm joining tang
36. Alternative joining clip, general

DETAILED DESCRIPTION OF THE PREFERRED EMBODIMENT(s)

FIG. 1 illustrates an assembled embodiment of the present invention, 1. The components illustrated are the berm wall panels 7, a support gusset bracket 2, corner clips 3, panel joining hooks 4, and the bracket mounting hooks 5, which form a T slot 8 into which the support bracket 2 is inserted, liner retaining spring clamps 6, spikes 21, and the liner 9.

Figure 3:
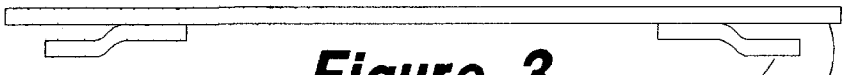
FIG. 3 is an edge view of a typical panel module showing the assembly hooks.
Figure 2:
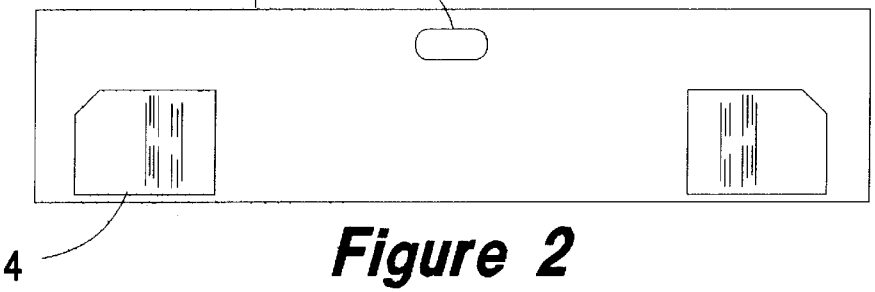
FIG. 2 is a front view of a typical panel module.

FIGS. 2 and 3 are orthographic views of a typical panel. The panel has joining hooks, 4, at each end comprising jogged plates welded, bolted, or riveted to the panel. The end hooks slidably engage slots in cooperating joining clips to connect adjacent panels into longer runs or to form corners. Clips on the interior portions of the panels accept gusset brackets which serve as footing to prevent the panels from sinking into the ground and resist overturning. The brackets 2 have holes through which securing spikes are driven into the ground, warehouse floor, or other surface to prevent bracket sliding and panel bowing.

Figure 4:
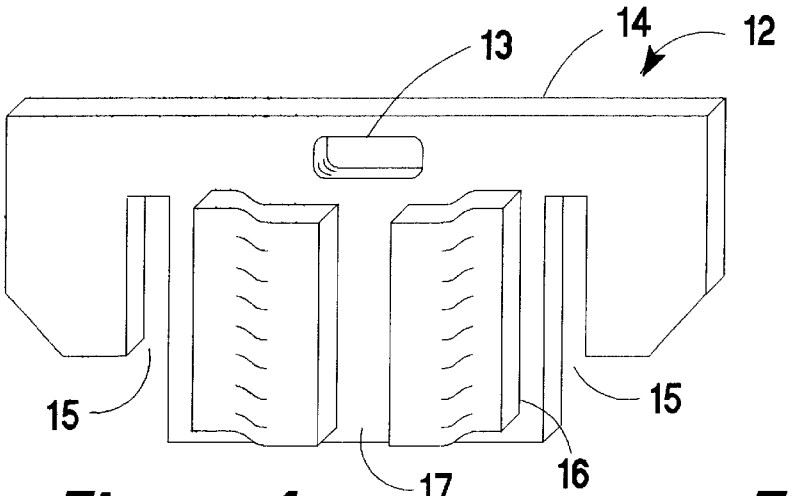
FIG. 4 is a view of the joining clip assembly.
Figures 11, 12, 13:
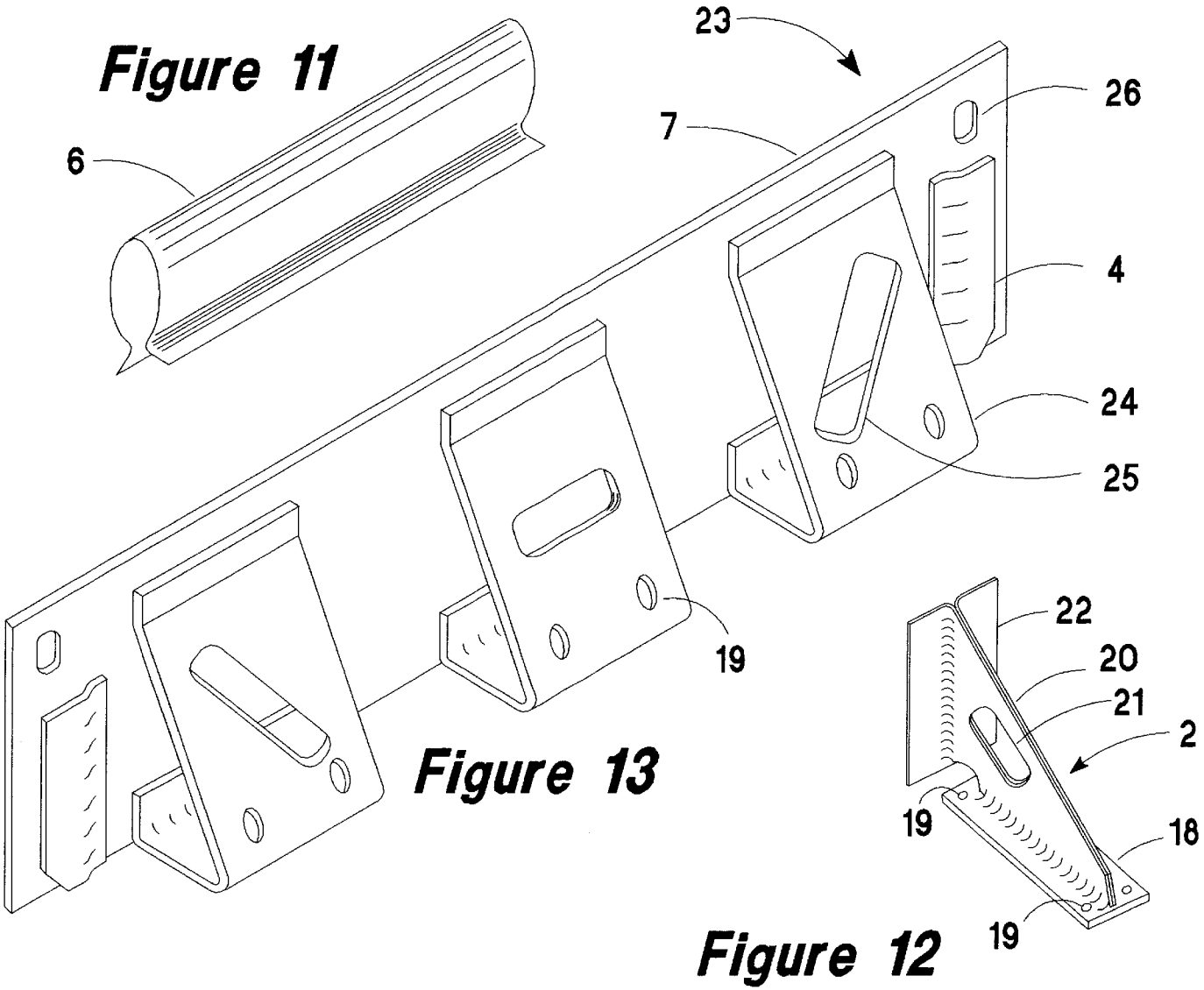
FIG. 11 is an isometric view of the liner holding spring clamp.
FIG. 12 is an isometric view of a typical support gusset bracket.
FIG. 13 is an isometric view of an alternate embodiment showing a preassembled panel.

FIG. 4 shows a typical panel joining clip assembly 12. A clip consists of a flat plate 14 with slots 15 and bracket hooks 16 symmetrically located around a center line. The bracket hooks face each other and form a T slot 17 for receiving a support gusset bracket, which is also shown in FIGS. 1, 4, and 12. A hand hold, 13, is generally included for handling the clip with one hand.

Figure 6:
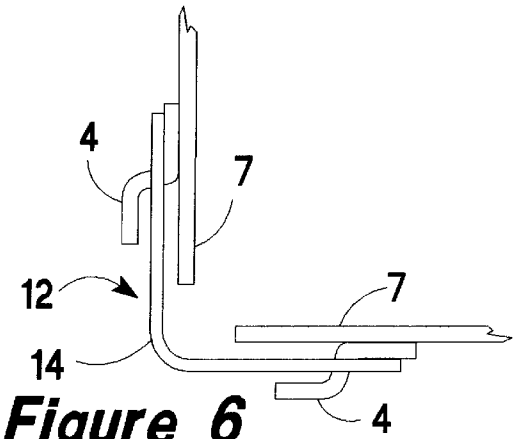
FIG. 6 is an edge view of an installed corner bracket.
Figure 5:
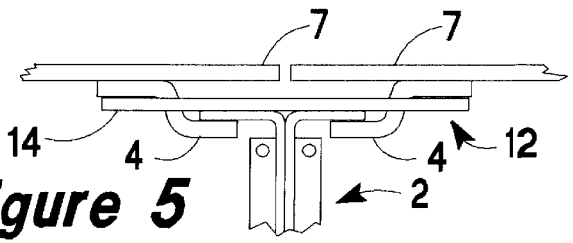
FIG. 5 is an edge view of an assembled panel joint showing an installed joining clip and gusset bracket.

When the joining clip is used to connect two panels, the two clip-plate slots 15 straddle the jogs of the joining hooks 4 of adjacent panel ends as shown in FIGS. 5 and 6. This locks the adjacent panels in position, preventing the two panels from either separating or moving together in an overlap, while permitting a modest amount of angling between adjacent berm panel. The clip base plate 14 may be jogged at slots 15 to provide a closer fit against the plank panel 7. The slots 15 may also be tilted inward or outward to permit adjacent panels to be angled vertically. Alternatively, the join clip can be fitted with a pivot for accommodating vertical angling.

Corner clips 3 are similar to the in-line joining clips of FIG. 4 except that corner clips do not have the gusset bracket hooks 16 and are bent as illustrated in FIG. 6. The most common corner bracket is bent 90 degrees. However other angles, in particular 125 and 157.5 degrees interior angle are particularly useful. Clips of 125 degrees makes a 45 degree turn in the berm wall, and 157.5 degree clips make a 22.5 degree tun. Of course, custom bending or hinged corner pieces may be utilized to turn a corner for specific purposes. Of particular use are corner pieces angled appropriately to form regular polygons such as 4, 5, 6, 8, 12, 16, and 32 sides. Polygons having six or more sides approach a circular shape. When pairs of longer panels are placed on opposite sides, the enclosure becomes approximately oval shaped, There is no requirement that the enclosure defined by the present invention be any specific shape. regular shapes may be constructed as needed to fit the requirements of the application.

FIGS. 1, 5, and 6 show the joining clip in use and illustrate the relationship of the various elements.

Clips for use where the expected loads are not severe may be fabricated from rod or bar stock as U-shaped staple-like clips.

FIG. 12 is an isometric detail of a gusset bracket 2. The gusset bracket illustrated is an assembly of two triangular pans 20 fixedly connected by welding, bolting, riveting, or similar. A set of wings or ribs 22 is connected to the pan for attaching to the bin panel by sliding the wings into the joining clip or panel T slot 17 or 8. Further, a foot pad 18 is attached to the pans to serve as a foot support the gusset bracket and attached panel on the ground. The attaching wings slide into the T slot between the bracket hook plates 4 on the panels or the hook plates 16 on the joining clip. There is no need for gusset brackets at the bin corners, as the corner provides its own resistance to overturning, FIG. 5 show a joining clip assembly with a gusset bracket installed.

The preferred fabrication material is aluminum sheet stock, but any materials suitable to purpose may be used, including other metals, composites, plastics, and wood. Thinner ribbed or corrugated sheet may be used, whereby the ribs or corrugations provide the necessary stiffness to the panels.

Hand holds are included wherever needed. At least one hand hold 11 at the center of each panel assembly is desired for carrying the panel. Aluminum panels are sufficiently light that only one centrally located hand hold is required for all except the longest models. The preferred hand holds are slots through which the hand is placed for gripping the panel. Handles of various shapes and locations are equally practical for manipulating the panels.

The formulae in Table I calculate typical forces to be expected on various parts and sizes of the berm structure. The calculations performed are illustrative and do not constitute a complete application design, and do not represent calculations of or to determine stress, strength, or section requirements, or consider the load bearing characteristics of the soil.

Figure 7:
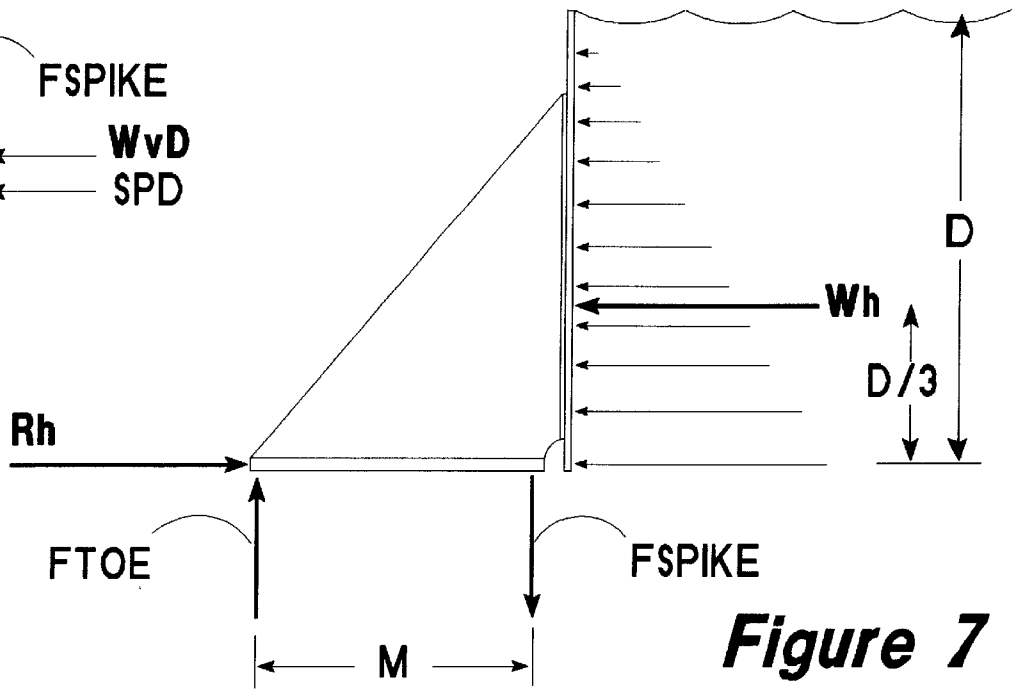
FIG. 7 is a free body diagram of a vertical berm wall

FIG. 7 illustrates that the fluid pressure is zero at the surface and maximum at the bottom. Integration indicates that the entire pressure can be represented by a single pressure operating on an area at ⅔ depth down from the surface. Another axiom of static free body analysis is that the all the forces can be represented by a set of vertical, horizontal, and torsional vector components. Each axis, vertical, horizontal, and torsional must be balanced to a net of zero. If not zero, the whole structure would be in motion, not static, by definition.

The largest overall forces are encountered when the bin is filled to the top. Refer to FIG. 7 for a free body diagram illustrating the points of action and directions the primary forces encountered in use. The small force vectors represent the incremental forces of small portions of the fluid being retained. These forces are summed (mathematically integrated using calculus) and combined into one equivalent force, Wh. Calculus also determines that the equivalent force acts on one point ⅓ up from the bottom of the fluid. Since all forces, in all linear and torsional axes, must sum to zero, the reaction forces can be calculated. For the configuration shown in FIG. 7; Rh=Wh, FTOE=FSPIKE, FTOE*M=WH*D/3. These calculations do not take into account the aiding forces provided by hydraulic pressure in the vicinity of the bottom corner of the liner.

Tables I and II set forth most of the basic principles and equations according to which calculations of the physical size and strength are made. These principals are universal and apply to vertical, sloped, and composite berm walls.

The equations of Table I indicate that the longer the foot, the smaller are the vertical forces on the foot.

For vertical walls, the toe force is upward, preventing the toe from sinking into the soil, and the heel force is downward and supplied by pinning to the ground. However an outward slope of only 10 degrees (80 from horizontal) takes advantage of the weight of the contents to provide a counter to the overturning moment An offset of 20 degrees (70 from horizontal) will offset all overturning moments and not require any spiking tie-down whatsoever.

The horizontal restraint at the base is required to prevent the bracket from slipping along the ground or warehouse floor. It is resisted by side forces distributed among the pinning nails. The amount of force on each pin is incalculable, but is generally expected to be roughly equal The interior of the berm bin is lined with an unbroken sheet of appropriate material 9. The liner is usually an impervious sheet of material chemically compatible with the expected contents and other environmental conditions. A suitable liner for use around an oil well is "HYTREL (™)" polyester elastomer by Dupont. Generally liner 9 is a continuous sheet of flat stock with the excess material at the corners folded 10 along a bin side wall.

The liner may be a fabricated "box" using appropriate joining methods at the corners.

The liner is laid in to conform to the sides and bottom of the bin, extending to the rim and folded over a few inches. An omega shaped spring clamp as shown in FIGS. 1 and 11 is pressed over the rim of the bin, clamping the liner to the upper panel. The liner clamping clip may be made of any resilient material such as plastic, spring steel, or non-ferrous spring metals. In emergencies, a length of wood may be slotted and pressed into place over the panel edge.

TABLE I

General Formulas For Calculating Foundation Loading

For Vertical Berm or Bin Wall

Use angle of 90 degrees

For Berm or Bin Wall Sloping Outwardly Alpha Degrees from Horizontal

Assume the weight of the panels is zero

Length of Gusset foot=LF

Horizontal hydraulic force on panel=Wh=density*depth*depth/2

Downward force on panel=Wv=Wh*cotangent(alpha)

Overturning moment=Wh*depth/3

Horizontal distance from panel bottom edge to point of action of vertical force=WvD=(D/3)/Tangent(ALPHA)

Vertical Resisting force at panel bottom=((Wh*D/3)−(LF−WvD))/(LF)

Vertical Resisting force at outer end of foot=((Wh*D/3)+(Wv*WvD))/(LF)

NOTE: Negative foot forces are in tension, and indicate that a hold-down means is required, IE, spiking, sandbagging, etc. Positive forces are pressing into the ground. The spikes shown in the figures primarily resist the horizontal forces urging the berm wall to slide away from the contents. Properly set spikes can act in tension also.

TABLE II

Axioms Pertaining To Free-Body Calculations

1. THE BODY IS AT REST.
2. ALL FORCES IN THE X, Y, OR Z AXIS EACH MUST SUM TO ZERO.

Otherwise, the body is would be in motion.
3. ALL TORSIONAL COUPLES AND FORCES MUST SUM TO ZERO.

Otherwise, the body would be spinning.
4. LINEAR FORCES MAY BE REPLACED BY ORTHOGONAL FORCES IN THE X, Y, AND Z AXIS.
5. ORTHOGONAL FORCES MAY BE COMBINED INTO ONE FORCE.
6. BY CONVENTION, FORCES SHOWN ARE SUPPORT OR ENVIRONMENTAL FORCES ACTING ON THE BODY, NOT FORCES FROM THE BODY TO THE ENVIRONMENT.

Axioms Pertaining To Hydraulic Forces

1. HYDRAULIC FORCE AT ANY POINT IS THE DENSITY*DEPTH AT THAT POINT. THIS REPRESENTS THE WEIGHT OF A COLUMN OF THE FLUID OVER THE AREA UNDER INVESTIGATION. THE FORCE IS ZERO AT THE SURFACE AND MAXIMUM AT THE BOTTOM.
2. AT ANY POINT WITHIN A FLUID, THE HYDRAULIC FORCES ACT EQUALLY IN ALL DIRECTIONS.
3. TOTAL HORIZONTAL FORCE ON A VERTICAL RECTANGULAR SURFACE UNDER FLUID=W*D*D/2, WHERE D IS THE DEPTH OF THE FLUID, AND W IS THE WIDTH OF THE RECTANGLE.
4. THE TOTAL FORCE ON A VERTICAL RECTANGULAR SURFACE MAY BE CONSIDERED AS CONCENTRATED AND ACTING ON A POINT ⅔ DEPTH BELOW THE SURFACE.

Other Embodiments and Variations

Figures 14, 15, 16, 17:
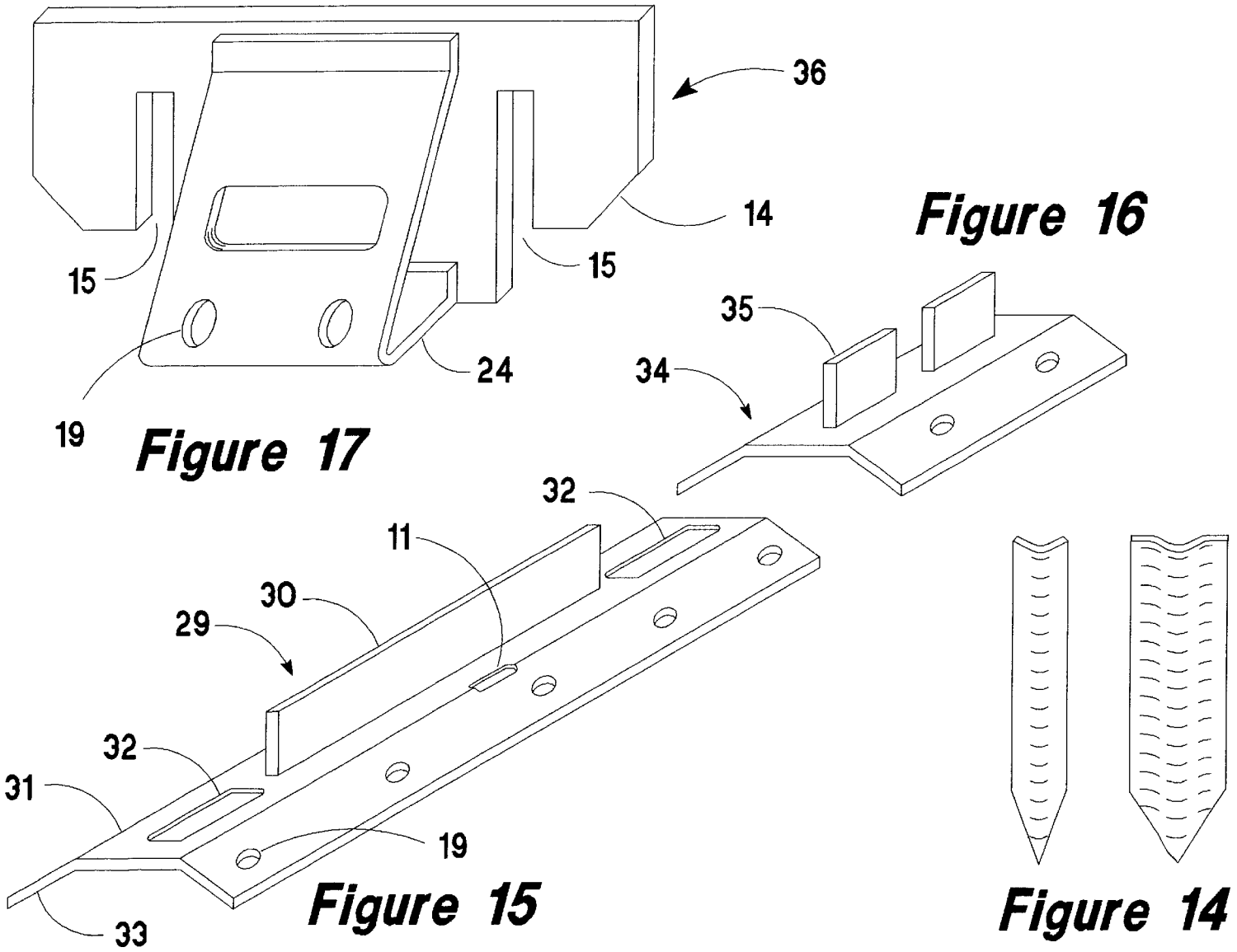
FIG. 14 is two embodiments of a drive post.
FIG. 15 is an isometric view of an alternative embodiment
FIG. 16 is an isometric view of the joining section for the alternative embodiment.
FIG. 17 is an isometric view of the straight joining clip.

FIG. 12 shows a basic embodiment of the support gusset bracket. A stiffening member or rib along the diagonal edge may be added to resist buckling of the shear panel and to provide compression strength to the gusset. Obviously, the gusset bracket can be assembled from other common structural sections such as angle stock or T sections fastened to the triangular shear panel to form the wings, foot, or stiffener portions. FIG. 13 shows a bracket assembly with integral, non-removable wing and foot parts. The holes 26 of the FIG. 13 embodiment are for hanging the panel onto the structure of a drilling platform for storage and transportation of the berm as drilling rig equipment. FIG. 17 is the straight joining clip of the integral-bracket, for use with the embodiment shown in FIG. 13. In the field, the components of the FIGS. 1, 2, 3, 4, 5, 6, 13, and 17 are interchangeable and may be intermixed in the same berm.

FIG. 15 shows an embodiment 29 comprising a low berm wall 30 and an integral foot. This embodiment is to be used for small enclosures or for surrounding a larger work area. The low berm is less than 1 foot high to permit the crew to step over. The purpose is to contain the small amount of contaminants being tracked around by the crew, to divert water and mud away from the worksite, and to demark the immediate work area without presenting a general barrier such as the primary containment berm or a fence requiring a gate. The foot 31 is illustrated as having gull-wings 33 which can be spiked, buried, or ice mortared to the ground. A flat T or L foot is a satisfactory alternative.

FIGS. 15 and 16 illustrate a pintle and gudgeon type joining. Blade 35 of the joining section 34 is passed through slot 32 at each end of the long panel piece 29. The footing of the joining section should be smaller than the matching section of the long piece to permit nesting of the two foot portions. The joining section may be bent to form a corner section or if the blade is a pin, then joined sections may be set at various angles.

Separate joining sections may be eliminated altogether by having the long panel pieces comprising a blade 35 at one end and slot 32 at the other end.

The low berm can also be constructed with joining hooks as described in the preferred embodiment. Then joining is by appropriately scaled clips of the same style as previously described.

Obviously, the regular berm of FIG. 1 or the panels of FIG. 13 can be scaled down to perform the same function as the FIG. 15 embodiment, but the FIG. 15 embodiment is simpler, less expensive, and easier of use for the reduced requirements where a small barrier is needed.

The spikes 21 at the outward end (toe) of the support bracket foot 18 are present primarily to provide the horizontal forces, Rh, which oppose the tendency to slide the bracket along the ground. These spikes may be replaced by a downward pointing portion at the toe end. This portion would be driven into the ground and present a significant vertical face under the soil to prevent horizontal sliding.

Similarly, the rear spikes resist both horizontal forces and provide the hold down forces to required prevent the inner end (heel) from rising. The rear spikes can be replaced by an extension on the T rib. When driven into the ground, the extension would provide pinning function and also tend press backwards against the ground and tend to lift a quantity of earth. Both of these can provide significant resistance to overturning.

In applications where the overturning moment is not severe, such as when retaining light materials, the support gusset bracket can be replaced by posts having An L, T, H, or V section driven into the earth. FIG. 14 shows two embodiments of a post. One is a simple V and the other has wings. In use, the edges of the V or the wings are slid into slots 8 or 17 in the same manner as the triangular gusset bracket.

While the figures illustrate depth of only one panel, the panels may be stacked to form 2 or 3 layer berms. Stacked panels use enlarged gusset brackets that support and vertically join the panels. An H-section bar or equivalent (not shown) can be used between stacked rows to add alignment and horizontal stiffening.

While the preferred method of forming a corner is to use a bent corner clip, it is within the optional configurations of the invention to bend the panel itself, thereby eliminating the corner clip entirely. Panels may also be bent into arcs for making curved bin walls.

Figure 8:
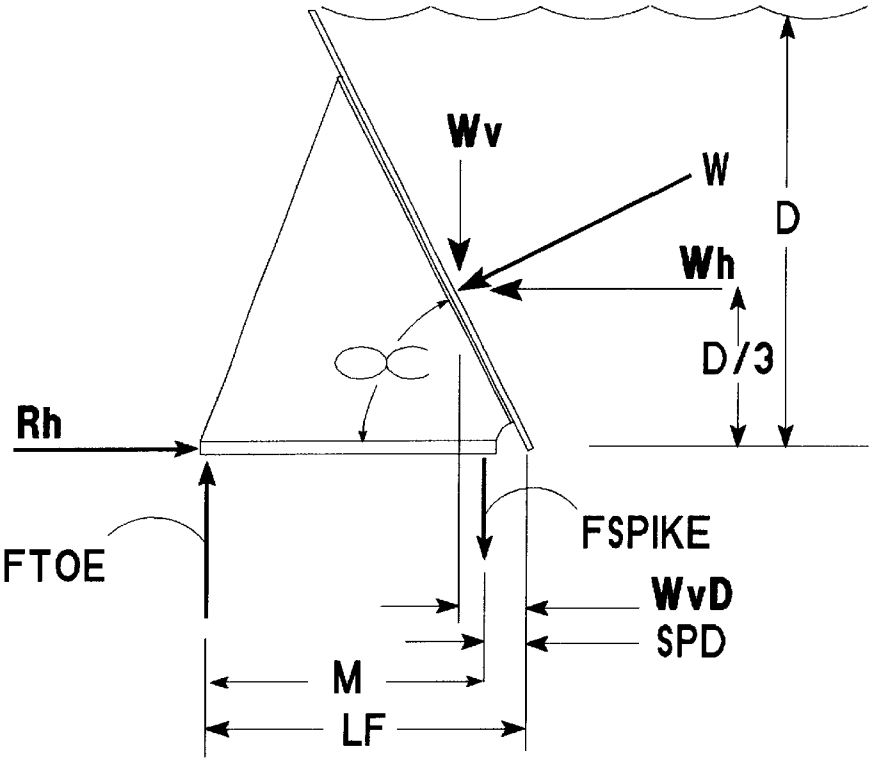
FIG. 8 is a free body diagram of an outwardly sloping berm wall
Figure 10:
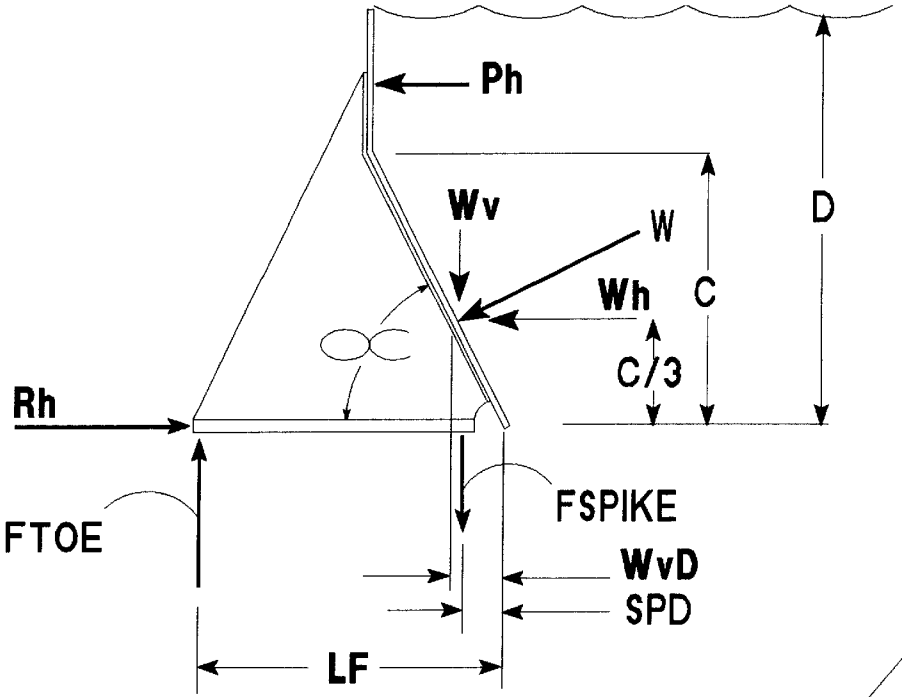
FIG. 10 is a free body diagram of a combined vertical and outwardly sloping wall.

The illustrations depict a bin or berm with vertical sides. Sloping berms can be installed by simply changing the angle of slots 16 to point inward at the open end, and constructing the gussets with an appropriate slope at the wings. The preferred berm wall slope is with the upper edge outward. FIGS. 8 and 10 show force diagrams for outward-sloping sided embodiments. The appropriate angles can be easily determined by simple trigonometry, scale drawings, or simple models.

Sloping makes a larger volume, but more importantly, the overturning moment is partly offset by the downward weight of the contents, and the bracket feet support the weight more evenly distributed over their entire area. FIG. 8 is the force diagram for a sloped wall. An outward slope of only 10 degrees (80 from horizontal) reduces the need for spildng hold-down at the heel to a few pounds. An outward slope of 20 degrees (70 from horizontal) will offset all overturning moments and not require any spiking tie-down whatsoever. Lengthening the foot pad on the gussets also reduces the amount of any heel lift to be restrained. The lift is never zero with vertical walls, and horizontal forces remain for all configurations.

There is nothing inherently limiting the angle of slope, but practical considerations suggest that 45 degrees is a maximum useful slope for a retaining bin wall. Larger slopes are practical when the bin wall is part of a materials handling feature such as a slope for aiding in loading or unloading the bin.

The figures also show two other optional embodiments to overcome the overturning moments. FIG. 10 shows a chamfered wall. The inward turn presents a horizontal projection of a surface upon which the weight of the berm contents acts. This geometry causes the center of pressure to move inward relative to a total sloping wall. The net effect is to use the sloping portion more effectively to offset the overturning moment. The overturning moment for all configurations relies only on the horizontal component of pressure on the face of the wall. The gravity derived moment resisting overturning relies only on the vertical component of pressure on any horizontal projection of sloped face.

The chamfer may be a whole panel, or an inwardly bent section of a panel at the bottom. When the horizontal projection of the sloping portion is small relative to the berm height, the preferred angle is from 0 (horizontal) to 45 degrees. Larger sloping portions can utilize larger angles. The more the sloping portion protrudes into the bin, the more effective it is in resisting overturning.

Figure 9:
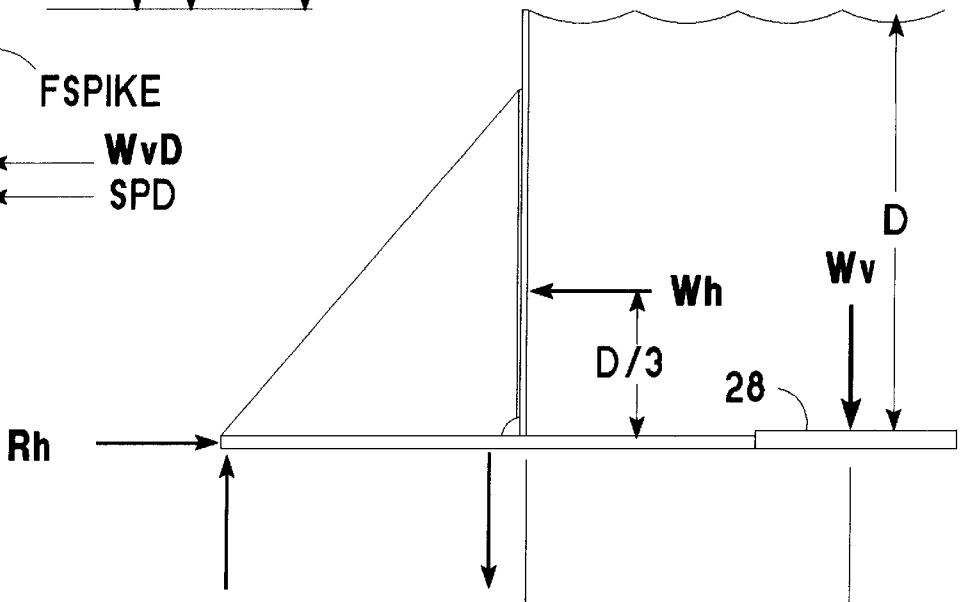
FIG. 9 is a free body diagram of a vertical berm wall with overturning-resisting foot pad.

Another embodiment is shown in FIG. 9. FIG. 9 shows an extension of the gusset foot under the berm liner. The weight of the material directly over the extension, which may be splayed into a paddle shape 28, provides considerable resisting moment to the overturning moment. Mathematically, there is no difference between the paddle and a horizontal extension of the panel.

The spring clip shown in FIGS. 1 and 11 is unbroken over its length. An optional feature is to cut series of slots a few inches apart. The cuts would be from the open edge to just below the beginning of the over-top curve. Such slots add flexibility and permit the clip to bend slightly and to conform to any panel curvature or to accommodate changing thickness in the liner due to folding, rivet heads, or other obstructions protruding from the panel surface.

The panel sections are easily handled by one or two workmen, but the liner for even a moderately size berm installation is heavy and awkward to handle. There is always a possibility that a forklift which is seldom available, would damage the sheet. A specialized handling system to dispense the liner can be installed on a truck. Such a dispenser would be either a reel upon which a partly folded sheet is wound or a large flat storage/dispensing bin containing the liner folded zigzag into a pad, and is dispensed in the manner utilized by fire trucks to lay canvas fire hose.

HOW TO USE THE INVENTION

The job site details will determine the minimum size and placement of the berm and in some cases site conditions limit the maximum height that can be installed to avoid interference with operations of machinery in and around the berm.

To customize the present invention for a particular installation, an estimate is made of how much volume should be contained for protection against a worst-case spill scenario and to meet industry and legal standards.

Then the volume of the proposed berm enclosure is calculated and compared to the worst-case requirement. If the proposed berm is too small, the perimeter or height has to be enlarged and recalculated. The various mensuration formulas to compute volumes of regular and irregular shapes are readily available. Formulas, charts, and nomograph can be provided in the installation kit of instructions. The ability to perform the calculations should be within the ordinary skill of an engineer or mechanic assigned to specify containment system described herein. It should also be within the ordinary skill of the mechanic assigned to oversee the installation of the containment berm system with the aid of installation charts, graphs, and nomographs to be supplied with the installation kit.

The route of the berm is laid out on the ground, the panels, gusset brackets, spikes, liner, and clips are brought to the job site and erected similarly to the illustration of FIG. 1.

The various panels are joined by sliding the slots in the joining clips over the hook at the end of the panel. The support gusset brackets are slid into the channels provide to attach them to the panels. The gusset brackets are spiked to the ground, the liner is tucked into the corners and pulled over the rim. When all is in place the liner retaining clips are installed and the berm is complete, ready to receive a spill and protect the surrounding environment.

The berm system as described may also be used as storage bins for bulk storage, walls for small low buildings, ditching or ditch liners, diversion dams, light duty retaining walls, and flood or run off water diking or diversion.

It is recognized that one skilled in the art will perceive other embodiments and variants in the spirit and nature of the invention. It is intended that such embodiments and variants are included within the monopoly extended by patent.

The embodiments of the invention in which an exclusive property right or privilege is claimed are defined as follows:

I claim:

1. A materials retaining berm system comprising:

a. at least three elongated panels each having a top edge, bottom edge, first and second faces, first and second ends, and first and second joining hooks located on the first face at said first and second ends; and b. said joining hooks further comprising a portion fixedly attached to and extending from said first panel face and an essentially flat surface portion fixedly attached to the distal edge of said extending joining hook portion and spaced apart from and parallel to said first panel face thereby forming a pocket for receiving a joining clip; and c. at least three joining clips for removably joining two said panels, said joining clips having first and second slots, each adapted to engage said extending portion of the joining hooks of adjacent panels and to occupy said pocket; and d. whereby said panels connected by said joining clips define an enclosed space for retaining materials therein.

2. The materials retaining berm system of claim 1 further comprising a flexible liner conforming approximately to the shape of said enclosed space, said liner being attached to said upper edges of each panel by at least one elastic clip, and where said attachment extends substantially along the entire upper edge of said panel.

3. The materials retaining berm system of claim 1 further comprising a joining clip adapted to join adjacent panels at an angled arrangement, where the said joining clip comprises two essentially flat portions each containing a slot adapted to engage said joining hooks of adjacent panels, said flat portions connected together at an dihedral angles, where said joining clip is adapted to join adjacent panels at a angle.

4. The materials retaining berm system of claim 1, said panels further comprising of at least one elongated hole near said top edge for carrying and manipulating the panel.

5. The materials retaining system of claim 1, further comprising a support attaching means fixedly attached to said first panel face, said support attaching means comprising two opposing hook having essentially flat portions spaced apart from and parallel to said first panel face thereby defining a T shaped keyway adapted for receiving a cooperating T shaped portion of a support bracket.

6. The materials retaining berm system of claim 1 further comprising a joining clip adapted to join adjacent panels in approximately co-linear arrangement, where the said joining clip is essentially flat, and having two slots adapted to engage said joining hooks of adjacent panels.

7. The joining clip of claim 6 further comprising support attaching means comprising two opposing hooks having essentially flat portions spaced apart from and parallel to said flat surface defining a T shaped keyway adapted for receiving a cooperating T shape portion of a support bracket.

8. The materials retaining berm system of claim 1 further comprising at least one support means to resist overturning and sliding forces, said support means comprising a gusset portion having at least three edges, first and second essentially flat portions fixedly attached to each of two adjacent edges where the first flat portion in cooperation with the gusset comprises a T shaped means adapted to cooperate with said T shaped keyway for removably attaching the support means to the said elongated panel, and where the second flat portion in cooperation with the gusset comprises a foot for supporting the said overturning and sliding forces.

9. The foot of claim 8 further comprising ground attachment means comprising at least one hole in said foot and at least one nail through said hole and penetrating the ground, thereby pinning the foot to the ground to resist sliding and overturning forces.

10. The materials retaining berm system of claim 1 further comprising at least one support means to resist overturning and sliding forces, said support means comprising a gusset portion having at least three edges, one edge fixedly attached to said first panel face, and a flat portion approximately perpendicular to the gusset portion where the flat portion in cooperation with the gusset comprises a foot for supporting the said overturning and sliding forces.

11. A materials retaining berm system comprising:

a. at least three elongated panels each having a top edge, bottom edge, first and second faces, first and second ends, and first and second joining hooks located on the first face at said first and second ends; and b. said joining hooks further comprising a portion fixedly attached to and extending from said first panel face and an essentially flat surface portion fixedly attached to the distal edge of said extending joining hook portion and spaced apart from and parallel to said first panel face thereby forming a pocket for receiving a joining clip; and c. at least three joining clips for removably joining two said panels thereby forming a corner of said retaining berm, said joining clips having two essentially flat portions fixedly connected to form a dihedral angle, and first and second slots near the distal edges of said flat portions each adapted to engage said extending portion of the joining hooks of adjacent panels and where the joining clips are restrained by said pockets; and d. a flexible liner comprising a least one flexible sheet folded to essentially conform to the shape of said enclosed space, said liner being attached to said upper edges of each panel by at least one elastic clip, where said attachment extends substantially along the entire upper edge of said panel, and e. whereby said panels connected by said joining clips define an enclosed space having a bottom and side wall liner for retaining materials therein.

12. The materials retaining berm system of claim 11 where said panels further comprising of at least one elongated hole near said top edge for carrying and manipulating the panel.

13. The materials retaining system of claim 11, further comprising a support attaching means fixedly attached to said first panel face, said support attaching means comprising two opposing hook having essentially flat portions spaced apart from and parallel to said first panel face thereby defining a T shaped keyway adapted for receiving a cooperating T shaped portion of a support bracket.

14. The materials retaining berm system of claim 11 further comprising a joining clip adapted to join adjacent panels in approximately co-linear arrangement, where the said joining clip is essentially flat, and having two slots adapted to engage said joining hooks of adjacent panels.

15. The joining clip of claim 14 further comprising support attaching means comprising two opposing hooks having essentially flat portions spaced apart from and parallel to said flat surface defining a T shaped key-way adapted for receiving a cooperating T shape portion of a support bracket.

16. The materials retaining berm system of claim 11 further comprising at least one support means to resist overturning and sliding forces, said support means comprising a gusset portion having at least three edges, first and second essentially flat portions fixedly attached to each of two adjacent edges where the first flat portion in cooperation with the gusset comprises a T shaped means adapted to cooperate with said T slot for removably attaching the support means to the said elongated panel, and where the second flat portion in cooperation with the gusset comprises a foot for supporting the said overturning and sliding forces.

17. The foot of claim 16 further comprising ground attachment means comprising at least one hole in said foot and at least one nail through said hole and penetrating the ground, thereby pinning the foot to the ground to resist sliding and overturning forces.

18. The materials retaining berm system of claim 11 further comprising at least one support means to resist overturning and sliding forces, said support means comprising a gusset portion having at least three edges, one edge fixedly attached to said first panel face, and a flat portion approximately perpendicular to the gusset portion where the flat portion in cooperation with the gusset comprises a foot for supporting the said overturning and sliding forces.

19. A materials retaining berm system comprising:

a. at least three elongated panels each having a top edge, bottom edge, first and second faces, first and second ends, and first and second joining hooks located on the first face at said first and second ends, and at least one support attaching means on the first face between said first and second joining hooks for removably attaching a support bracket adapted to resist overturning and sliding of said panel; and b. said joining hooks further comprising a portion fixedly attached to and extending from said first panel face and an essentially flat surface portion fixedly attached to the distal edge of said extending joining hook portion and spaced apart from and parallel to said first panel face thereby forming a pocket for receiving a joining clip; and c. at least three joining clips for removably joining two said panels thereby forming a corner of said retaining berm, said joining clips having two essentially flat portions fixedly connected to form a dihedral angle, and first and second slots near the distal edges of said flat portions, each adapted to engage said extending portion of the joining hooks of adjacent panels and where the joining clips are restrained by said pockets; and d. a flexible liner comprising a least one flexible sheet folded to conform essentially to the shape of said enclosed space, said liner being attached to said upper edges of each panel by at least one elastic clip, where said attachment extends substantially along the entire upper edge of said panel, and e. said support attaching means further comprising two opposing hook having essentially flat portions spaced apart from and parallel to said first panel face thereby defining a T shaped keyway adapted for receiving a cooperating T shaped portion of a support bracket; and f. at least one support means to resist overturning and sliding forces, said support means comprising a gusset portion having at least three edges, first and second essentially flat portions fixedly attached to each of two adjacent edges where the first flat portion in cooperation with the gusset comprises a T shaped means adapted to cooperate with said T shaped keyway for removably attaching the support means to the said elongated panel, and where the second flat portion in cooperation with the gusset comprises a foot for supporting the said overturning and sliding forces; and g. whereby said panels connected by said joining clips define an enclosed space having a liner for retaining materials therein and support means to resist forces tending to overturn, bend, or slide the panels.

20. The materials retaining berm system of claim 19 where said panels further consisting of at least one elongated hole near said top edge for carrying manipulating the panel.

21. The materials retaining berm system of claim 19 where said foot further comprises ground attachment means comprising at least one hole in said foot and at least one nail through said hole and penetrating the ground, thereby pinning the foot to the ground to resist sliding and overturning forces.

* * * * *